US009331385B2

(12) United States Patent
Kwon et al.

(10) Patent No.: US 9,331,385 B2
(45) Date of Patent: May 3, 2016

(54) PORTABLE TERMINAL

(71) Applicant: Samsung Electronics Co., Ltd., Gyeonggi-do (KR)

(72) Inventors: Tae-Wook Kwon, Gyeonggi-do (KR); Jong-Min Kim, Gyeonggi-do (KR); Sang-Ho Hong, Gyeonggi-do (KR); Yang-Tack Oh, Gyeonggi-do (KR); Ok-Kyung Lee, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 588 days.

(21) Appl. No.: 13/650,663

(22) Filed: Oct. 12, 2012

(65) Prior Publication Data

US 2013/0093640 A1 Apr. 18, 2013

(30) Foreign Application Priority Data

Oct. 14, 2011 (KR) ..... 10-2011-0105356

(51) Int. Cl.
*H01Q 1/52* (2006.01)
*H01Q 1/24* (2006.01)

(52) U.S. Cl.
CPC ..... *H01Q 1/52* (2013.01); *H01Q 1/243* (2013.01); *H01Q 1/528* (2013.01)

(58) Field of Classification Search
CPC ..... H01Q 1/52; H01Q 1/243; H01Q 1/528
USPC ..... 343/702, 841, 876
See application file for complete search history.

(56) References Cited

U.S. PATENT DOCUMENTS

| | | | | |
|---|---|---|---|---|
| 7,253,773 | B2 * | 8/2007 | Chiba et al. | 343/702 |
| 2002/0080565 | A1 * | 6/2002 | Teshima | 361/681 |
| 2005/0270244 | A1 * | 12/2005 | Lam et al. | 343/702 |
| 2009/0146874 | A1 * | 6/2009 | Tsai et al. | 342/357.06 |
| 2010/0231459 | A1 | 9/2010 | Kawata et al. | |
| 2010/0302110 | A1 * | 12/2010 | Leem | 343/702 |

FOREIGN PATENT DOCUMENTS

| | | | |
|---|---|---|---|
| KR | 10-2009-0042094 | A | 4/2009 |
| KR | 10-0932420 | B1 | 12/2009 |
| KR | 10-2010-0113938 | A | 10/2010 |
| KR | 10-2011-0034283 | A | 4/2011 |

* cited by examiner

*Primary Examiner* — Dieu H Duong
(74) *Attorney, Agent, or Firm* — Cha & Reiter, LLC.

(57) ABSTRACT

Apparatus for improving the reception sensitivity of a portable terminal includes: a peripheral body combined with a main body; a main circuit board mounted to the peripheral body and providing a connection terminal; an antenna formed on the main circuit board; a module arranged to be adjacent to the antenna; and a ground portion installed between the module and the peripheral body, for conducting noise which has been induced into the antenna, into the peripheral body by conducting current through the module and the peripheral body.

21 Claims, 3 Drawing Sheets

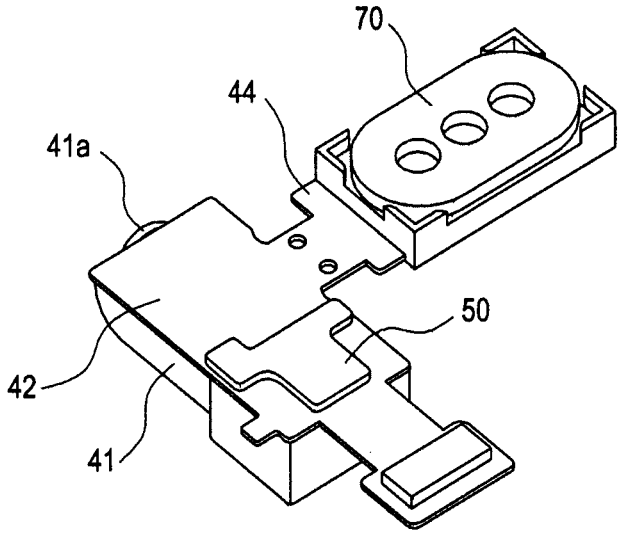
FIG.4
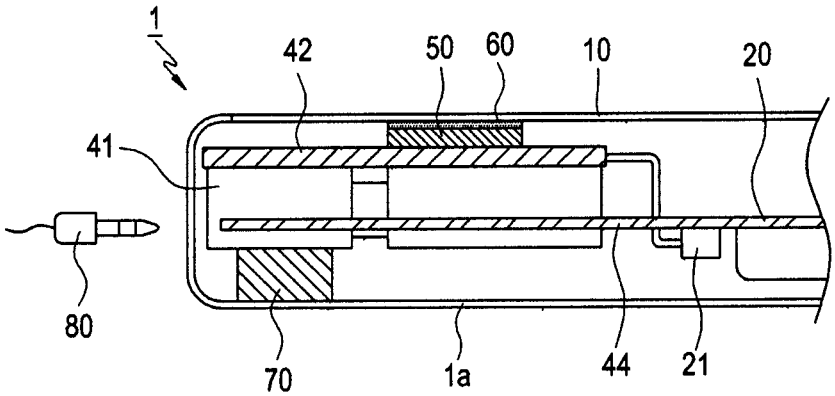
FIG.5
| | RECEPTION STRENGTH OF DIVERSITY ANTENNA | | IMPROVEMENT RATE (%) |
|---|---|---|---|
| | BEFORE APPLICATION (dBm) | AFTER APPLICATION (dBm) | |
| SHV-E110S | -76 | -85 | 11.8% |
| SHV-E120S | -74 | -83 | 12.1% |
| SHV-E120K | -80 | -88 | 10.0% |
| SHV-E120L | -75 | -84 | 12.0% |
FIG.6

PORTABLE TERMINAL

CLAIM OF PRIORITY

This application claims priority under 35 U.S.C. §119(a) to a Korean Patent Application entitled "Portable Terminal" filed in the Korean Intellectual Property Office on Oct. 14, 2011 and assigned Serial No. 10-2011-0105356, the contents of which are incorporated herein by reference in its entirety.

BACKGROUND OF THE INVENTION

1. Field of the Invention

The present invention relates to a portable terminal, and more particularly to a portable terminal in which noise induced into an antenna can be reduced, so as to improve the reception performance of the antenna, and in particular, an antenna of a portable terminal implementing a Long Term Evolution (LTE) service.

2. Description of the Related Art

As a high-quality multimedia service is provided together with a voice communication service through a portable terminal for mobile communication, a wireless communication technology is getting a lot of attention due to the convergence of itself with a next-generation wireless communication service such as LTE.

In order to smoothly receive a multimedia service provided by such a wireless communication technology, a rate for transmitting huge amounts of multimedia data at high speed must be guaranteed. Therefore, research on an antenna of a portable terminal suitable for a high-speed data transmission rate has been continuously conducted.

Typically, a voice communication service-based communication system using a Single-Input Single-Output (SISO) system, uses only a single antenna element that mainly has narrow-band channel characteristics in a limited frequency domain. However, a SISO system using such a single antenna has many difficulties when transmitting large amounts of data at high speed in a narrow-band channel.

Therefore, there has been a need for a Multiple-Input Multiple-Output (MIMO) technology which is a next-generation wireless transmission technology by which each antenna of a plurality of antennas can be independently driven and data can be transmitted at a higher data transmission/reception rate with a lower error probability. These MIMO antennas have an advantage in that limited frequency resources can be efficiently used by using multiple antennas at a transmission/reception end of the communication system.

The conventional technology of these MIMO antennas is disclosed in Korean Patent Laid-Open Publication No. 10-2010-0113938 (Publication Date: Oct. 22, 2010, Title of the Invention: Broad-band MIMO (Multi-Input Multi-Output) Antennas), Korean Patent Registration No. 10-0932420 (Registration Date: Dec. 9, 2009, Title of the Invention: MIMO Antenna System), etc.

However, these MIMO antennas which are installed in a limited space of a portable terminal, raise a problem in that high interference between the antennas is caused by an electromagnetic wave emitted between the antennas. The MIMO antennas installed in the portable terminal are arranged at positions, which are physically as far apart from each other as possible in the portable terminal.

Recently, in a bar-shaped portable terminal which implements an LTE system, a primary transmission/reception antenna among the MIMO antennas is located at a lower end of the portable terminal, and a diversity reception antenna among the MIMO antennas is located at an upper end of the portable terminal.

However, due to the characteristics of the bar-shaped portable terminal, elements including a motor (such as typically used to generate a vibration as a "call alert"), an earphone jack, a camera, a sensor, etc. are arranged near the diversity reception antenna. These elements generate various noises including an electromagnetic wave. When a frequency band of these noises overlaps (or duplicates) the reception frequency band of the diversity reception antenna, noises generated by the elements are induced into the antenna, so that problems occur in that not only is the reception strength of the antenna reduced, but the performance of the antenna is also reduced.

Even furthermore, the reduced reception strength and performance of the antenna causes a problem in that the reliability of a portable terminal in an LTE system is reduced because the LTE system has to transmit/receive data at high speed with a low error probability.

SUMMARY OF THE INVENTION

The portable terminal of the present invention includes: a peripheral body combined with a main body; a main circuit board mounted to the peripheral body, a connection terminal; an antenna formed on the main circuit board; a module arranged near the antenna so as to be adjacent to the antenna; and a ground portion installed between the module and the peripheral body, for conducting any noise, which has been induced into the antenna, into the peripheral body by conducting current through the module and the peripheral body.

A portable terminal in another embodiment of the invention, includes: an antenna mounted in a predetermined area of a main body; a module arranged near the antenna; a peripheral body mounted so as to be adjacent to the module; and a ground portion installed between the module and the peripheral body, the ground portion conducting current through the module and the peripheral body so as to reduce an amount of noise that would otherwise be induced into the antenna.

The antenna, when used in portable terminal implementing an LTE system, may include a diversity reception antenna, where a primary antenna is installed in the portable terminal at a position that is maximally separated from the position where the diversity reception antenna is installed in the portable terminal.

The present invention further provides a method for reducing an amount of noise that is induced into an antenna of a portable terminal, by: mounting an antenna in a predetermined area of a main body of the portable terminal; arranging a module near the antenna; mounting a peripheral body so as to be adjacent to the module; and installing a ground portion between the module and the peripheral body, such that the ground portion can conduct current through the module and the peripheral body and thereby reduce an amount of noise that would otherwise be induced into the antenna, thus using the antenna as a diversity reception antenna.

BRIEF DESCRIPTION OF THE DRAWINGS

The above and other exemplary features, aspects, and advantages of the present invention will be more apparent from the following detailed description taken in conjunction with the accompanying drawings, in which:

FIG. 4 is a perspective view showing a state in which an earphone jack module is combined with a display unit bracket in a portable terminal according to an exemplary embodiment of the present invention;

FIG. 5 is a cross-sectional view of a portable terminal according to an exemplary embodiment of the present invention; and FIG. 6 is a table showing a rate of improving the reception strength of an antenna by including a ground portion in a portable terminal according to an exemplary embodiment of the present invention.

DETAILED DESCRIPTION OF EXEMPLARY EMBODIMENTS

Figure 1:
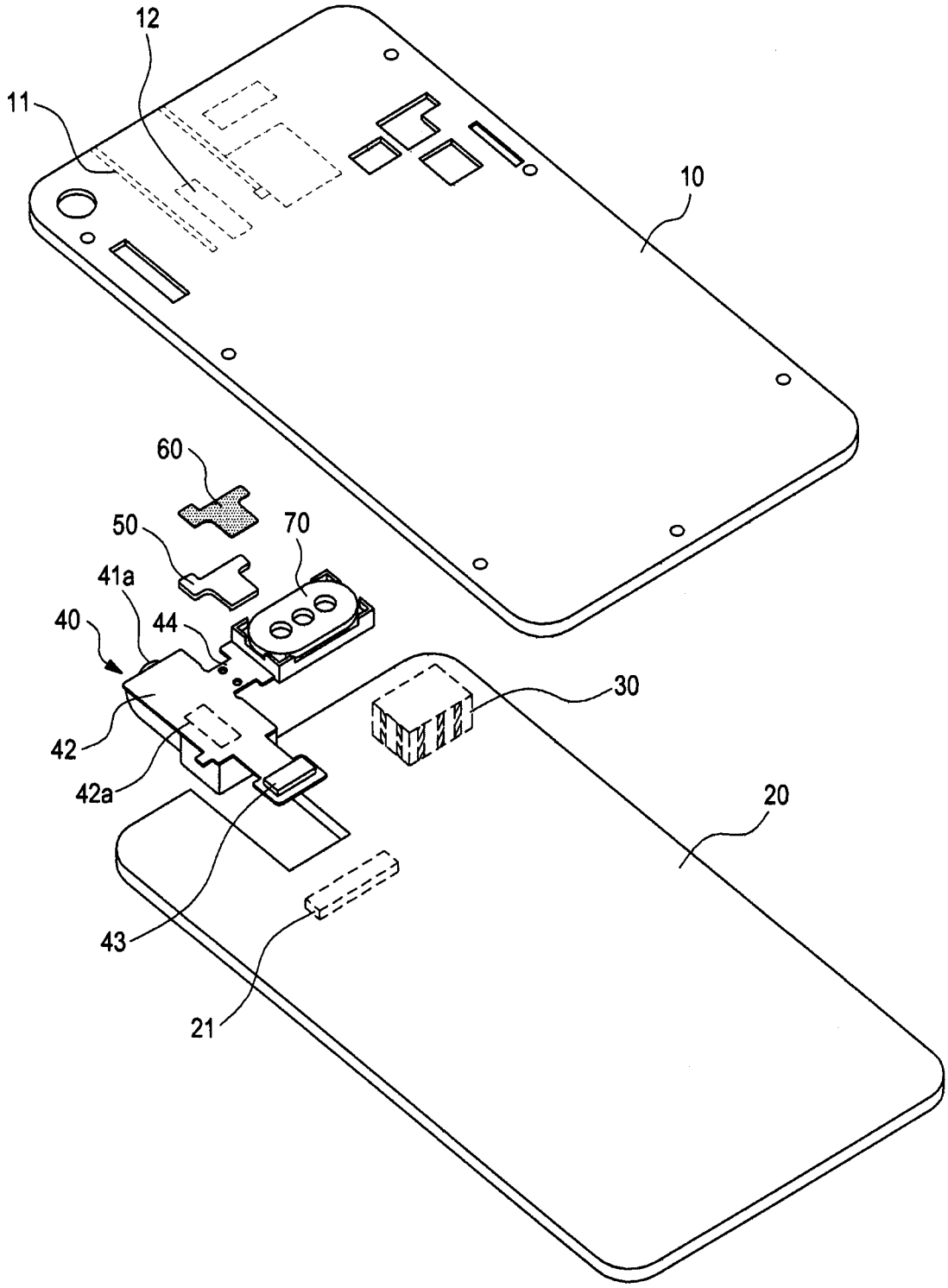
FIG. 1 is an exploded perspective view schematically showing portions of a portable terminal according to an exemplary embodiment of the present invention.

Hereinafter, an exemplary embodiment of a portable terminal according to the present invention will be described with reference to the accompanying drawings. In the description, the thicknesses of lines or the sizes of elements etc. shown in the drawings may be illustrated in an enlarged manner for the clarity and convenience of the description. Also, terms described below, which are defined considering functions in the present invention, can have a different meaning depending on user and operator's intention or practice. Therefore, it should be understood that the terms are to be defined based on the disclosure throughout this specification.

Figure 2:
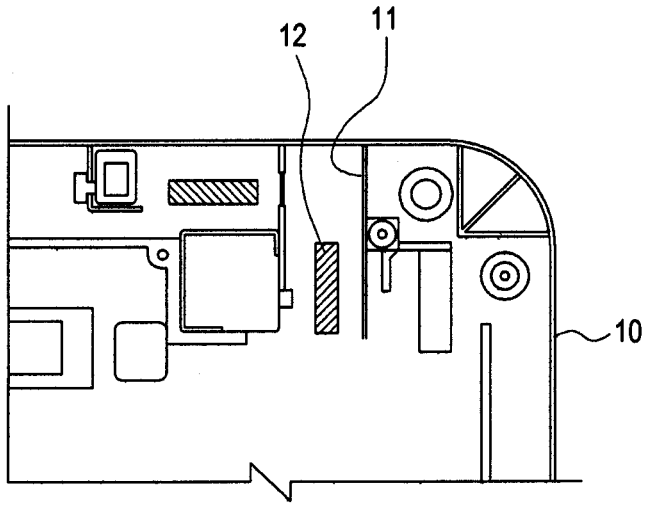
FIG. 2 is a view showing one surface of a display unit bracket in a portable terminal according to an exemplary embodiment of the present invention.

Referring to FIG. 1, FIG. 2 and FIG. 5, a portable terminal 1 according to the present invention includes a main body 1*a*, a peripheral body 10, a main circuit board 20, modules 40, and a ground portion 50.

In this exemplary embodiment, a description will be made of an example where the main body 1*a* of the portable terminal 1 has a bar shape. However, the portable terminal 1 is not limited to this example. It goes without saying that various modifications and alternations may be made in the shape and style of the portable terminal 1. For example, the portable terminal may have the shape of a slide a folder or similar type portable terminal 1, as long as the portable terminal 1 has a shape such that the portable terminal 1 has various multimedia functions and the portable terminal 1 may implement an LTE system capable of transmitting data at high speed.

The peripheral body 10 is combined with the main body 1*a* of the portable terminal 1, and is installed so as to support the main body 1*a*. That is, the present invention discloses a configuration of the body 10 such that the bracket surrounds or supports the main body 1*a*.

In this exemplary embodiment, the peripheral body 10 is a display unit bracket 10 installed between a part of the main body 1*a* and another part of the portable terminal, and the display unit bracket 10 is made from a magnesium alloy material. However, the peripheral body 10 is not limited to this example and various modifications and alternations may be made in the configuration or the material of the peripheral body 10 capable of supporting the main body 1*a* of the portable terminal 1 and eliminating the induced noise by the conduction of current through the peripheral body 10 and the ground portion 50 as described below.

A display member (not shown), a printed circuit board 42 as described below, etc. are mounted to an upper end of the display unit bracket 10, and a battery (not shown), etc. are mounted to a lower end of the display unit bracket 10.

Various upper end mounting members (not shown) for implementing multimedia functions are installed on one surface of the display unit bracket 10. Particularly, a module mounting portion 12, to which the module 40 as described below is mounted, is formed at an upper side part of the display unit bracket 10. In the module mounting portion 12, a first ground surface 12 grounded to the ground portion 50 as described below is exposed, and contacts a ground portion 50 so as to be able to conduct current through the first ground surface 12 and the ground portion 50.

The main circuit board 20 is mounted inside the display unit bracket 10, and a connection terminal 11 is provided on one surface of the main circuit board 20. The main circuit board 20 is mounted so as to oppose one surface of the display unit bracket 10, and a display member, etc. are located at an upper surface part of the display unit bracket 10 and a battery, etc. are located at a lower surface part thereof.

An antenna 30 for transmission/reception with a base station and upper side mounting members, which enable the implementation of various multimedia functions, are mounted at an upper side of the main circuit board 20. In this exemplary embodiment, the upper side mounting members collectively refer to all modules 40, which include a camera module, a sensor module, a speaker module, an earphone jack module, etc., mounted at an upper end of the main circuit board 20 (shown generally as the left side of FIG. 1). Also, a module 40 on which the ground portion 50 is mounted, refers to one of the upper side mounting members, which is arranged so as to be adjacent to the antenna 30. In this exemplary embodiment, although a description will be made of an example where the ground portion 50 is mounted on the earphone jack module 40, when a module 40 adjacent to the antenna 30 is the speaker module 70, the ground portion 50 may be mounted on the speaker module. Otherwise, when a module 40 adjacent to the antenna 30 is the camera a module, the ground portion 50 may be mounted on the camera module.

The antenna 30 may be formed on the main circuit board 20, and multiple antennas may be formed as the antenna 30 in the main body 1*a*, in order to implement an LTE system for transmitting/receiving data at high speed and transmitting/receiving large amounts of data in a short period of time. In this exemplary embodiment, multiple antennas 30 have an identical polarization, so as to prevent interference between the multiple antennas. In this exemplary embodiment, a description will be made of an example where the antenna 30 corresponds to Multiple-Input Multiple-Output (MIMO) antennas including a diversity reception antenna and a primary transmission/reception antenna which are mounted at an upper end side and a lower end side, respectively, of the main body 1*a*. Also, in order to enable a low mutual correlation between a diversity antenna and a primary antenna, the diversity reception antenna and the primary transmission/reception antenna are installed at positions maximally separated from each other in the main body 1*a*. Although not shown in the drawings, the primary transmission/reception antenna is mounted at a lower end of the portable terminal 1 (shown generally as the right side of FIG. 1), and the diversity reception antenna is mounted at an upper end thereof.

As previously noted, the antenna 30 is not limited to this configuration, and various modifications and alternations may be made in an antenna 30 which enables the implementation of the LTE system.

Figure 3:
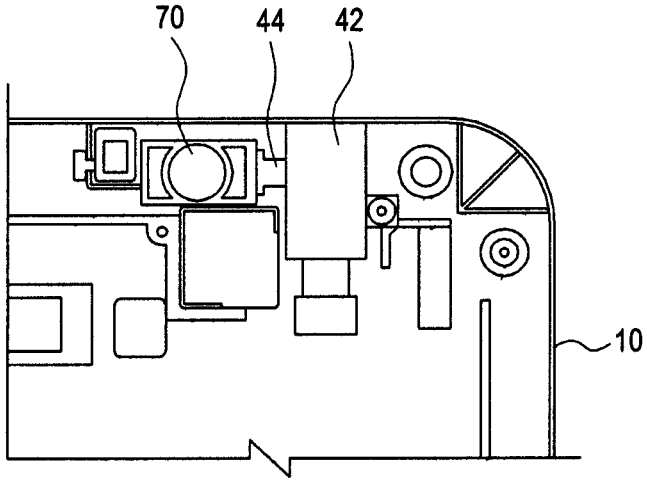
FIG. 3 is a view showing a state in which a ground portion is mounted on an earphone jack module and a printed circuit board of a portable terminal according to an exemplary embodiment of the present invention.

Referring to FIG. 3 and FIG. 4, the module 40 is arranged so as to be adjacent to the antenna 30 near the antenna 30. The ground portion 50 is arranged on an outer surface of the module 40 in such a manner that noise generated by the upper side mounting member and the like on the main circuit board 20 is induced into the side of the display unit bracket 10. In this exemplary embodiment, although the description has been made of an example where the module 40 is the earphone jack module 40, the module 40 is not limited to this example. As described above, the module 40 may be replaced by another module 40 which is arranged so as to be adjacent to the antenna 30 and has a configuration capable of inducing the noise induced into the side of the antenna 30 into the side of the display unit bracket 10.

In this exemplary embodiment, the earphone jack module 40 is arranged between the main circuit board 20 and the display unit bracket 10, and is located on the main circuit board 20 so as to be connected to and be combined with a connection terminal 21 of the main circuit board 20, as described in greater detail below.

The earphone jack module 40 includes an earphone jack housing 41, the printed circuit board 42, and a connector terminal 43.

An upper side part of the earphone jack housing 41 is located at the upper end of the display unit bracket 10 so as to be connected to the outside, and an earphone jack socket 41*a* is mounted at the upper side part of the earphone jack housing 41 in such a manner that an earphone jack 80 is inserted/removed into/from the earphone jack socket 41*a*. One side surface of the earphone jack housing 41 is connected to the printed circuit board 42 as described below.

The earphone jack housing 41 is mounted on one surface of the printed circuit board 42, and a second ground surface 42*a* grounded to the ground portion 50 is formed on the other surface of the printed circuit board 42 (used in the same meaning as a rear surface). The connector terminal 43, which is connected to the connection terminal 21 of the main circuit board 20, is extendedly formed at an end part of the printed circuit board 42 by a flexible printed circuit board. Therefore, the printed circuit board 42 is installed in such a manner that noise generated on the main circuit board 20 is induced via the connection terminal 21, the connector terminal 43, the printed circuit board 42, and the ground portion 50 into the first ground surface 12 of the display unit bracket 10.

Additionally, the speaker module 70 is mounted on a portion 44 of the printed circuit board 42 which is extendedly formed at a side part of the printed circuit board 42.

Referring to FIG. 5, the ground portion 50 is installed between the earphone jack module 40 and the display unit bracket 10 in such a manner as to be able to conduct current through the printed circuit board 42 and the display unit bracket 10.

One surface of the ground portion 50 is mounted so as to oppose the second ground surface 42*a*, and the other surface of the ground portion 50 is mounted so as to oppose the first ground surface 12 of the display unit bracket 10.

A combining member 60 is installed between the ground portion 50 and the display unit bracket 10. The combining member 60, which may comprise a conductive double-sided adhesive tape, combines the ground portion 50 with the display unit bracket 10 in such a manner that current can be conducted through the ground portion 50 and the first ground surface 12.

As a result of the antenna being arranged to be adjacent to the earphone jack module 40, the ground portion 50 conducts noise induced into the side of the antenna 30, away from the antenna 30 and into the side of the display unit bracket 10.

In this exemplary embodiment, although the combining member 60 is a conductive double-sided adhesive tape, the combining member 60 is not limited to this example. For example, the combining member 60 may be implemented by an element which has conductivity so that noise generated by the upper side mounting member, etc. may be induced into the display unit bracket 10 through the combining member 60 and which has a configuration capable of combining the display unit bracket 10 with the ground portion 50.

Herein, SHV-E110S, SHV-E120S, SHV-E120K, and SHV-E120L are product model numbers of portable terminals 1, to which an LTE system of Anycall™ of Samsung Electronics Co., Ltd. is applied.

The advantageous operation of the foregoing embodiments will now be described in conjunction with FIG. 6, which shows a measured rate of improvement for the reception strength of an antenna, which is achieved by including a ground portion in a portable terminal according to an exemplary embodiment of the present invention.

Referring to FIG. 6, after the ground portion 50 is mounted between the earphone jack module 40 and the display unit bracket 10 which are included in the portable terminal 1 to which the LTE system is applied, when a measurement is made of an improvement rate of reception strength of the antenna 30 (in this exemplary embodiment, the antenna 30 refers to a diversity reception antenna) mounted at the upper end side of the main body 1*a* of the portable terminal 1 (that is, the left side of FIG. 1), it can be seen that a reception strength of the antenna 30 increases by 10% or more than before including the ground portion 50 in the portable terminal 1. Namely, the reception sensitivity of the antenna 30 increases.

When transmission/reception of large amounts of data for using various multimedia functions of the portable terminal 1 is performed, noise generated by the upper end mounting members for implementing multimedia functions (such as the fore noted motor, camera module, sensor module, speaker module, earphone jack module, etc.) is induced into the printed circuit board 42, which has been arranged so as to be adjacent to the antenna 30, through the main circuit board 20. Then, the noise induced into the printed circuit board 42 is induced into the display unit bracket 10 through the second ground surface 42*a*, the ground portion 50, and the first ground surface 12. Therefore, the noise generated by the upper end mounting member is eliminated. Due to the elimination of the generated noise, the reception strength of the antenna of the portable terminal 1, to which the LTE system is applied, increases, and it is possible to accurately transmit/receive data at high speed.

As described hereinabove, in the portable terminal according to an aspect of the present invention, the module arranged near the antenna induces the noise, which has been induced into the antenna, into the side of the display unit bracket, so as to eliminate the induced noise. Therefore, the reception performance of the antenna can be improved.

Also, the improvement in the reception performance of the antenna can guarantee a rate for transmitting huge amounts of data at high speed in the portable terminal to which the LTE system is applied. Also, due to the high-speed data transmission rate, a portable terminal having a high data transmission/reception rate and a low error probability may be implemented, and the reliability of the portable terminal, to which the LTE system is applied, can be improved.

Meanwhile, although the specific exemplary embodiments have been shown and described in the description of the present invention as described above, various changes in form and details may be made in the specific exemplary embodiments of the present invention without departing from the spirit and scope of the present invention. Therefore, the spirit and scope of the present invention is not limited to the described embodiments thereof, but is defined by the appended claims and equivalents.

What is claimed is:

1. A portable terminal, comprising:

a main body coupled to a peripheral body;

a main circuit board mounted on the peripheral body, the main circuit board including a first terminal;

an antenna disposed on the main circuit board;

a module disposed on the main circuit board, the module being disposed adjacently to the antenna, and the module including a printed circuit board that is coupled to the first terminal of the main circuit board; and a ground portion installed between the module and the peripheral body, wherein the first terminal, the printed circuit board, and the ground portion are arranged to transfer channel noise generated in the main circuit board to the peripheral body.

2. The portable terminal as claimed in claim 1, wherein the peripheral body is made from a magnesium alloy material.

3. The portable terminal as claimed in claim 1, wherein the peripheral body comprises a display unit bracket.

4. The portable terminal as claimed in claim 1, wherein the peripheral body includes a module mounting portion having an exposed first round surface that is coupled to ground portion.

5. The portable terminal as claimed in claim 1, wherein the module comprises an earphone jack module.

6. The portable terminal as claimed in claim 5, wherein:

the earphone jack module comprises an earphone jack housing coupled to the printed circuit board, the printed circuit board includes a second terminal that is connected to the first terminal.

7. The portable terminal as claimed in claim 6, further comprising an electrically conductive combining part connecting the ground portion to a first grounding surface of a mounting part.

8. The portable terminal as claimed in claim 7, wherein the combining part comprises an electrically conductive double-sided adhesive tape.

9. The portable terminal as claimed in claim 8, wherein upper end mounting parts are installed adjacently to the module on the main circuit board.

10. The portable terminal as claimed in claim 1, wherein the antenna comprises:

a diversity reception antenna; and a primary antenna installed in the main body at a position maximally separated from the diversity reception antenna.

11. The portable terminal as claimed in claim 1, wherein the antenna comprises a diversity reception antenna, and a primary antenna is installed at a position in the main body that is maximally separated from the diversity reception antenna, the diversity reception antenna and primary antenna providing a Long-Term Evolution (LTE) communication service for the portable terminal.

12. A portable terminal, comprising:

a main body coupled to a peripheral body;

a main circuit board mounted on the peripheral body, the main circuit board including a terminal;

an antenna disposed in the main body;

module arranged near the antenna, the module including a printed circuit board that is coupled to the first terminal of the main circuit board;

the peripheral body disposed adjacently to the module; and a ground portion installed between the module and the peripheral body, wherein the first terminal, the printed circuit board and the ground portion are arranged to transfer channel noise generated in the main body to the peripheral body.

13. The portable terminal as claimed in claim 12, wherein the antenna comprises a diversity reception antenna.

14. The portable terminal as claimed in claim 13, wherein a primary antenna is installed at a position in the main body that is maximally separated from the diversity reception antenna, the diversity reception antenna and primary antenna providing a Long-Term Evolution (LTE) communication service for the portable terminal.

15. The portable terminal as claimed in claim 12, wherein the module comprises an earphone jack module.

16. The portable terminal as claimed in claim 12, wherein the peripheral body is made from a magnesium alloy material.

17. The portable terminal as claimed in claim 16, wherein the peripheral body comprises a display unit bracket combined with the main body.

18. The portable terminal as claimed in claim 17, wherein the ground portion is mounted on an outer surface of the module.

19. The portable terminal as claimed in claim 18, further comprising an electrically conductive combining part connecting the ground portion to a first grounding surface of a mounting part.

20. A method for reducing an amount of noise that is induced into an antenna of a portable terminal, comprising:

a main body coupled to a peripheral body of the portable terminal;

a main circuit board mounted on the peripheral body, the main circuit board including a terminal;

mounting the antenna in the main body of the portable terminal;

arranging a module including a printed circuit board that is coupled to the terminal of the main circuit board near the antenna;

mounting the peripheral body so as to be adjacent to the module; and installing a ground portion on the module and the module mounting part of the peripheral body;

wherein the terminal, the printed circuit board and the ground portion are arranged to transfer channel noise generated in the main circuit board to the peripheral body.

21. The method of claim 20, comprising:

using the antenna as a diversity reception antenna, and installing a primary antenna in the portable terminal at a position in the main body that is maximally separated from the diversity reception antenna, so that the diversity reception antenna and primary antenna provide a Long-Term Evolution (LTE) communication service for the portable terminal.

* * * * *

UNITED STATES PATENT AND TRADEMARK OFFICE

CERTIFICATE OF CORRECTION

PATENT NO. : 9,331,385 B2
APPLICATION NO. : 13/650663
DATED : May 3, 2016
INVENTOR(S) : Tae-Wook Kwon et al.

It is certified that error appears in the above-identified patent and that said Letters Patent is hereby corrected as shown below:

In the Claims

Column 7, Claim 4, Line 24 should read as follows:
--...first ground surface that...--

Signed and Sealed this
Twenty-first Day of June, 2016

Michelle K. Lee

Michelle K. Lee
*Director of the United States Patent and Trademark Office*